US007297012B1

(12) United States Patent
Hwang et al.

(10) Patent No.: US 7,297,012 B1
(45) Date of Patent: Nov. 20, 2007

(54) LOCKING CLIP FOR ELECTRICAL CONNECTOR

(75) Inventors: Liang Hwang, Hightstown, NJ (US); Peter T Kerekes, Carteret, NJ (US)

(73) Assignee: UTStarcom, Inc., Alameda, CA (US)

( * ) Notice: Subject to any disclaimer, the term of this patent is extended or adjusted under 35 U.S.C. 154(b) by 0 days.

(21) Appl. No.: 11/461,274

(22) Filed: Jul. 31, 2006

(51) Int. Cl.
*H01R 13/625* (2006.01)

(52) U.S. Cl. ..... 439/347; 439/902

(58) Field of Classification Search ..... 439/347, 439/701, 902

See application file for complete search history.

(56) References Cited

U.S. PATENT DOCUMENTS

| | | | | |
|---|---|---|---|---|
| 3,150,908 | A * | 9/1964 | Verrone | 439/347 |
| 3,993,394 | A | 11/1976 | Cooper | |
| 4,407,042 | A * | 10/1983 | Schramme et al. | 16/2.1 |
| 4,544,225 | A * | 10/1985 | Raus et al. | 439/345 |
| 4,619,490 | A | 10/1986 | Hawkings | |
| 4,764,130 | A | 8/1988 | DiClemente | |
| 4,871,323 | A * | 10/1989 | Ohsumi | 439/188 |
| 4,927,388 | A | 5/1990 | Gutter | |
| 5,013,258 | A * | 5/1991 | Schaef | 439/347 |
| 5,125,854 | A | 6/1992 | Bassler et al. | |
| 5,145,411 | A | 9/1992 | Pastal et al. | |
| 5,207,593 | A * | 5/1993 | Bogiel | 439/352 |
| 6,478,631 | B1 | 11/2002 | Dutton et al. | |
| 6,899,569 | B2 * | 5/2005 | Frank | 439/701 |
| 7,008,253 | B2 * | 3/2006 | Szczesny | 439/352 |
| 2004/0077205 | A1 * | 4/2004 | Holmes et al. | 439/347 |

OTHER PUBLICATIONS

AMP Catalog 1-1773441-4_1005, CHAMP Interconnection System, p. 72, Oct. 2005.
AMP Catalog 1-1773441-4_1005, CHAMP Interconnection System, p. 80, Oct. 2005.
AMP Catalog 82008_0596, Minature Ribbon Connector System (CHAMP), p. 9, May 1996.
AMP Latch, locking, CHAMP-LOK Part 552723, Drawing No. 552723, customer drawing, single sheet, dated 1980.
AMP Publication 408-3160, Instruction Sheet, Mounting Hardware for CHAMP Connectors, pp. 1 of 2 and 2 of 2, Oct. 8, 2003.

* cited by examiner

*Primary Examiner*—Thanh-Tam Le
(74) *Attorney, Agent, or Firm*—Patents and Licensing LLC; Daniel W Juffernbruch; John G Fijolek

(57) ABSTRACT

An electrical connector plug assembly has an outer shell containing at least one electrical contact module acting as an electrical contact plug. The outer shell works in cooperation with a separate connector receptacle assembly which has an inner shell containing at least one electrical contact module acting as an electrical contact receptacle. The outer shell of the electrical connector plug assembly is outfitted with an improved retaining device which secures the outer and inert shells of the connectors together over the joined electrical contact modules within those shells. The preferred connector retaining device is a clip which is attached so that the main body of the clip is in contact with an exterior surface of the plug with extending tabs which hold the clip in position upon slots on the interior surface of the plug and exterior surface of the receptacle shell.

18 Claims, 3 Drawing Sheets

LOCKING CLIP FOR ELECTRICAL CONNECTOR

BACKGROUND OF THE INVENTIONS

1. Technical Field

The present inventions relate to the field of electrical connectors, and more particularly, relate to a multiple-part connector assembly which is assisted by the use of a locking or retainer clip.

2. Description of the Related Art

Electrical connectors are available in many different designs, to serve a broad base of requirements. A frequently used design includes a plug and receptacle, each of which includes a contact or terminal module, including a dielectric housing in which contacts or terminals are secured; and a shell member surrounding the housing for physical protection and also for shielding and grounding purposes. Conventional methods for securing the plug and receptacle shells to each other include the use of adhesive materials, locking rings, or other retention hardware.

Examples of electrical connectors which are useful in the applications for which the present connector is useful are described below, to provide a background for the present improved connector.

U.S. Pat. No. 3,993,394 to James Cooper, issued Nov. 23, 1976, discloses a connector half having substantially parallel transverse walls joined by perpendicular sides to provide a substantially rectangular cross-section to receive at least one flat connector wafer inserted therein in a forward axial direction. A transverse rib is formed on an upper face of a wafer facing an inner face of a connector transverse wall. A spring clip cantilevered on the inner face of the connector half is provided. When the wafer is inserted into the connector half, the rib acts as a cam against the spring clip, forcing the spring clip up. The spring clip returns to abut the rear of the rib as the wafer is pushed into position, to retain the wafer in the connector half. A tool is provided for camming the spring clip to allow removal of the wafer.

U.S. Pat. No. 4,619,490 to Robert Hawkings, issued Oct. 28, 1986, describes a guidance and retention device for terminated connector wafers having a housing and at least one pair of opposed wafer retention members, said members releasably secured to opposed walls of the housing to provide the guidance and retention of rectangular-shaped connector wafers there between. The wafer retention members are described as being easily relocated to allow for reorganization of connector wafers and of a wiring array. In particular, these retention members comprise one member releasably connected to a first opposed wall and the other member releasably connected to a second opposed wall, each member having a plurality of guidance portions and retention portions which guide conductor wafers which are inserted in a stacked relationship within the housing.

U.S. Pat. No. 4,764,130 to Thomas DiClemente, issued Aug. 16, 1988, discloses an electrical connector having a retaining member which has a transverse section seated in an aperture in the connector housing. The forward end of the retaining member is folded back on itself and fits into an opening in the connector housing. A pair of retaining legs extend outwardly from the transverse section to engage an inside surface of the connector housing; these retaining legs work in cooperation with the folded member to hold the retaining member in position within the connector housing. In addition, a second pair of retaining legs extend inwardly into the connector housing passageway to retain the terminal housing in position within the connector housing. The metal shell (connector housing) which surrounds the terminal housing is of a single piece construction, and is used in combination with retaining members are formed from a metal as well, and are described as being stamped and formed from a material having desirable spring characteristics, such as, for example, stainless steel.

U.S. Pat. No. 4,927,388 to David Gutter, issued May 22, 1990 discloses a single piece protective shell of an electrical connector which includes clip members affixed to the inside of the protective shell, with spring arms of the clips extending forwardly and inwardly to latch behind transverse ribs along the outwardly facing surfaces of the terminal modules inserted into the shell. Each clip includes a pair of outwardly directed tabs along lateral edges of the body section, and the tabs are inserted outwardly through associated longitudinal slits in the shell wall and then bent over along the outward surface of the shell, preferably into grooves to be flush with the outward shell surface. A pair of such clips along the upper inside surface and along the lower inside surface cooperate to retain a pair of terminal modules inserted into the shell.

U.S. Pat. No. 5,125,854 to Bassler et al., issued Jun. 30, 1992 describes an electrical connector assembly which includes a shield and frame member wherein at least a portion thereof is conductive. A plurality of modular sub-assemblies is mounted in the assembly. A latch mechanism is provided for removably securing each modular sub-assembly to the shield and frame member. The latch mechanism includes a tab which extends from the shield and frame member, wherein the tab has a groove which fits over a projection on the modular sub-assembly.

U.S. Pat. No. 5,145,411 to Pastal et al., issued Sep. 8, 1992, describes a dielectric insert of an electrical connector retained within a metal shell by a plurality of latching ledges formed integrally with the insert member. The ledges are spaced about the periphery of the outer surface of the insert member, and during insertion into the shell member, these ledges are engaged with corresponding stop surfaces defined along inside surfaces of the metal shell.

U.S. Pat. No. 6,478,631 to Dutton, et al., issued Nov. 12, 2002 describes a connector assembly where the outer shell is comprised of two half shells which are open during attachment of a contact module retaining device to each of the half shells. The two half shells are joined to form a connector housing after attachment of the module retaining device. The preferred module retaining device is a clip which is attached so that the main body of the clip is in contact with an interior surface of the half shell. The clip is precisely aligned within the half shell using snap fit contacts which hold the clip in position until the half shells are joined, after which the clips may be held in position by contact with the interior surface of the half shell alone.

Many of the electrical connectors described above find use in airline and in lifeline telephony applications, and particularly for signal transmission applications. Due to the criticality of reliable performance, the connectors must meet stringent requirements, which may include a locking mechanism for vibration resistance per military standard MIL-STD-1344, which requires that there be no damage or electrical discontinuity after vibration testing. Further, any locking mechanism must provide a means of securing the module that should not interfere with insertion of the plug into the receptacle, particularly where the receptacle is mounted to a printed circuit board and where the angle of the connector exposes the securing means to the exterior environment in a manner which may cause the securing means to fail, and should provide for a careful alignment of the modules within the shell. This latter feature ensures proper electrical engagement within the connector.

Not only must the connector meet the technical requirements specified above, but as always, the cost of manufacturing the connector is an important consideration.

SUMMARY OF THE INVENTIONS

The present invention provides an electrical connector assembly kit that includes an outer connector shell containing at least one electrical contact module (plug) that is fitted with a removable retaining device that may remain secured to the plug while it is in a connected or unconnected state. In a connected state, the kit connects to an inner connector containing at least one electrical contact module (receptacle). The outer shell works in cooperation with the retaining device which secures the connector plug and connector receptacle together ultimately holding the electrical contact modules within the closed assembly.

The combination of the outer shell with the retaining device attached protects the important elements of the connection from exterior environments, does not interfere with insertion of the outer shell into the inner shell, and provides for a precise alignment of the plug and receptacle connectors. In particular, when the two half shells are joined to form a connector housing the attachment of the retaining device ensures that the cable connectors are secure and is especially designed to accommodate retention for angled exit access limited cable connections.

In particular, a complete electrical connection includes both a plug half and a receptacle half, and the following description applies to each half of the connection. The outer shell of the connector is comprised of an open sleeve around a contact module. The shell of one connector will fit exactly into the shell of its mating connector guiding attachment of the contact modules in each half. The two halves are closed (enjoined) after insertion of the contact module plug into the contact module receptacle and then secured by the clip retaining device that was already resting in place clipped to the sides and encircling the screw plane of the connector plug outer shell. Preferably, the shells are joined, with clip retaining device in place, and are then permanently screwed into the closed configuration through the screw plane of the connector plug. Typically the shells are rectangular in shape with rounded edges and are fabricated from cadmium or nickel plated aluminum or molded plastic, depending on the end use application. The closed, assembled shell with retaining device in place is capable of encompassing the contact module which contains the electrical contacts and is capable of retaining this connection on a printed circuit board or other connector application.

Due to the ability to screw the clip onto the connector outer shell assembly, the clip can be attached to the connector assembly in a manner which provides easy and precise alignment even in angled cable connections to printed circuit boards. Such angled connections are cases where a traditional clip design would be difficult or impossible to access or properly position and subsequently would not align as easily or precisely. Further, this novel clip design provides for more secure attachment of the free connector to its mated connector assembly where a traditional clip would not be as secure. Additionally, the ability to store the clip already attached to the outer connector shell assembly greatly reduces any chance of the clip getting lost or separated from a connector assembly kit in storage.

The details of the preferred embodiments and these and other objects and features of the inventions will be more readily understood from the following detailed description when read in conjunction with the accompanying drawings wherein:

DETAILED DESCRIPTION OF THE PREFERRED EMBODIMENTS

Figure 1:
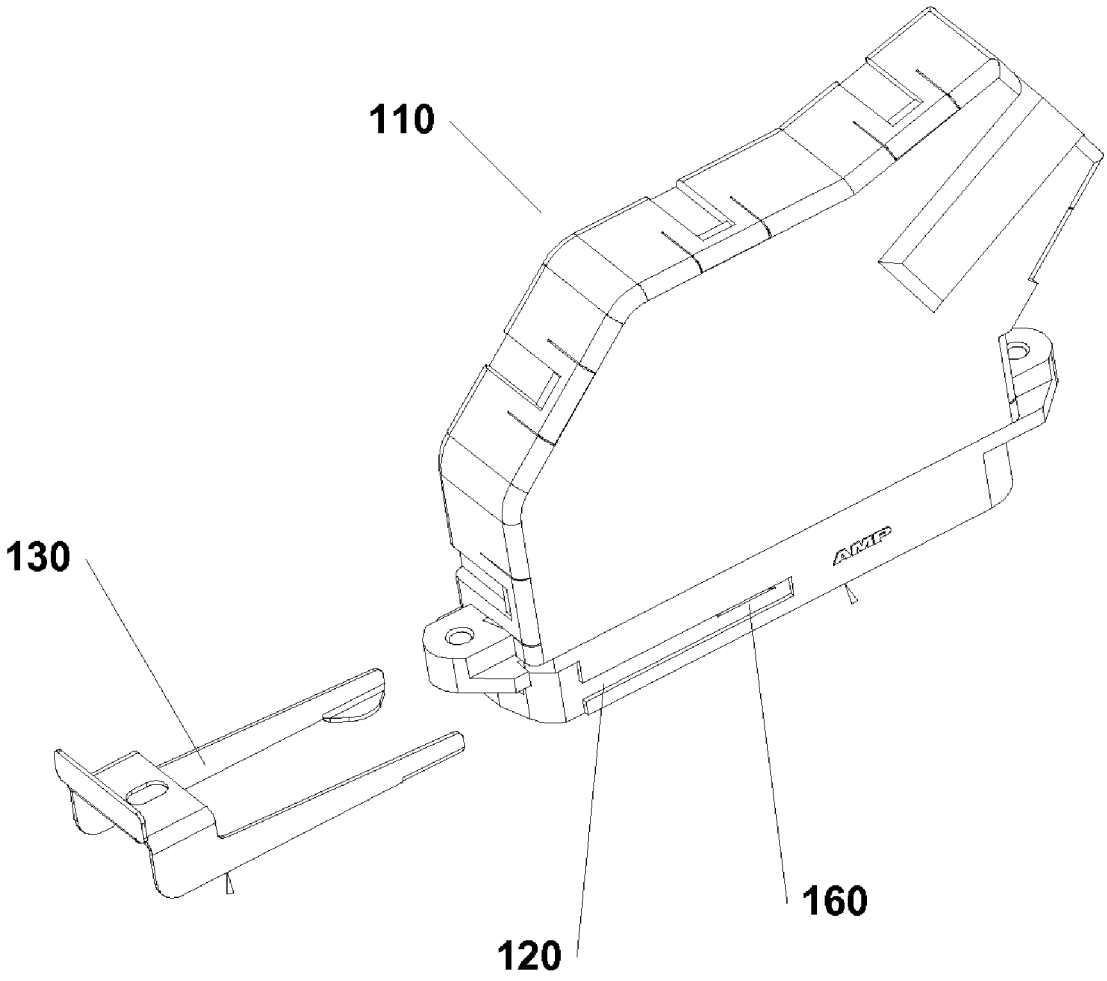
FIG. 1 illustrates a schematic block diagram of a plug connector's outer shell with retaining clip according to the present inventions.
Figure 2:
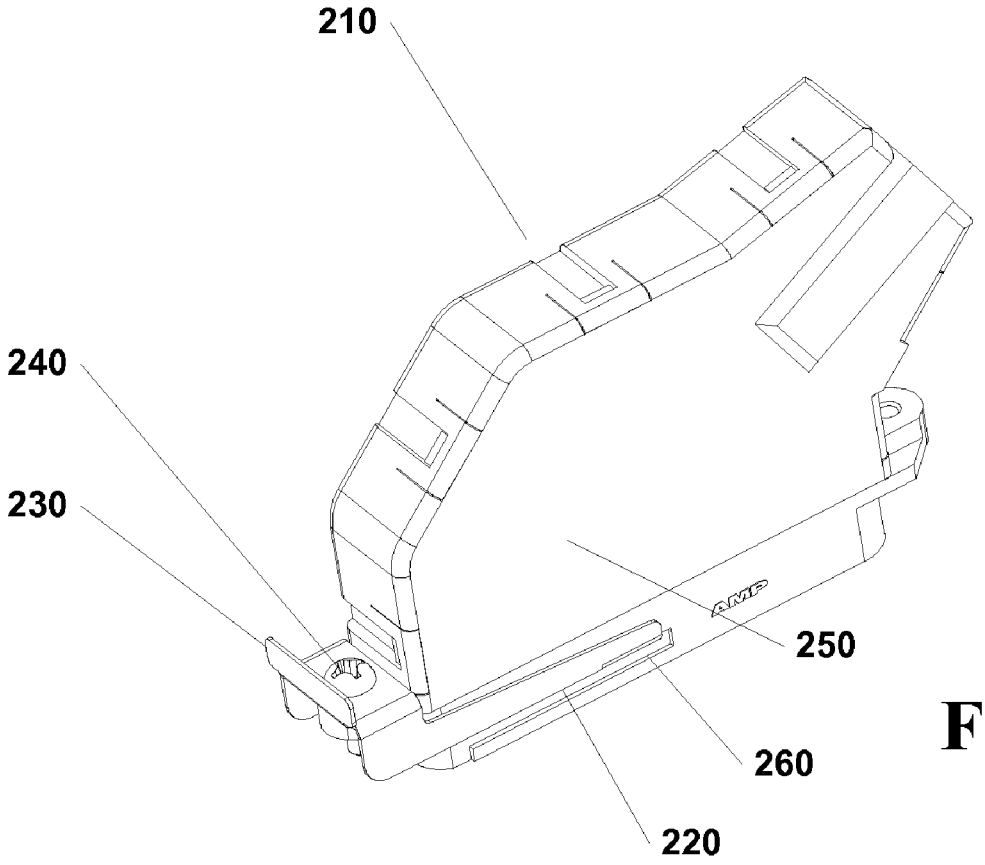
FIG. 2 illustrates a schematic block diagram of the top view of an exemplary connector kit with angled entry plug connector with retaining clip of the present inventions.
Figure 3:
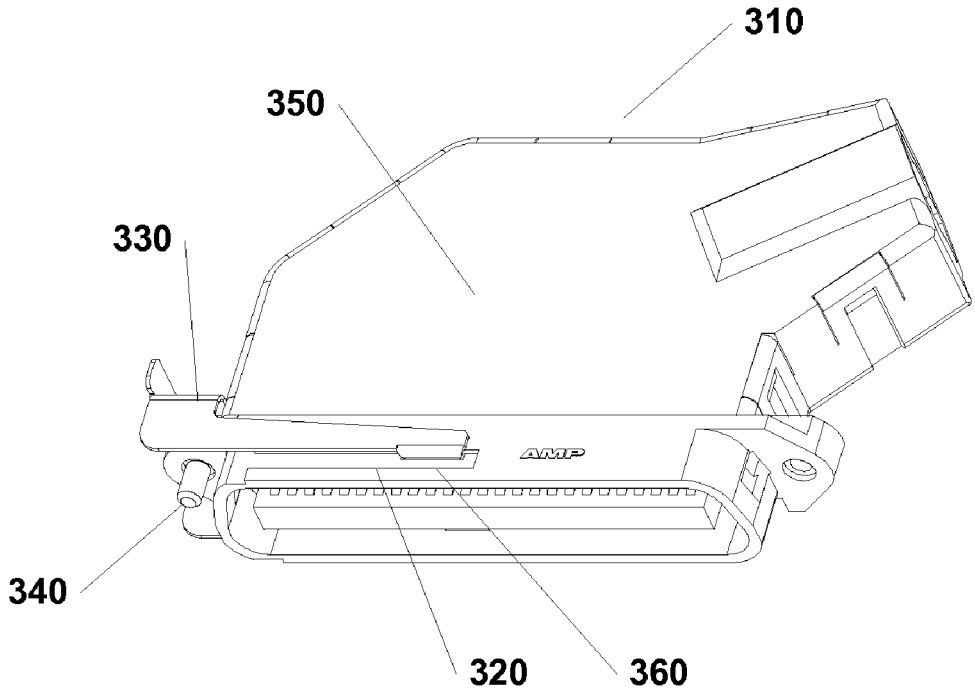
FIG. 3 illustrates a schematic block diagram of the bottom view of an exemplary connector kit with angled entry plug connector with retaining clip of the present inventions.

The use of the outer shell plug connectors each having a module retaining clip attached prior to use constructed in accordance with the principles of the present invention is shown in FIG. 1, FIG. 2 and FIG. 3 thereto gives rise to a particular kit electrical plug connector assembly, the kit comprising:

a) a connector outer shell assembly as in 110 or 210 or 310, which contains an electrical contact module b) a planed surface on said connector outer shell 350 extended past the contact module to allow secure fastening of the elongated member of connector 330 to a receptacle by a rivet or screw through the seating surface of the connector as in 240 or 340 c) A retaining clip 130 that can be attached to the connector outer shell assembly as in 110 or 210 or 310 in a mechanically secure manner prior to the use of the connector through a snap-fit as in 220 or 320 across the longitudinal surface of the connector and through the optional screw hole alignment on the connector seating surface as in 230 or 330.

In the preferred embodiment, a clip is attached so that the main body of the clip is in contact with the exterior surfaces of the outer shell of the plug connector with tabs extending through the interior surface of that outer shell and into the exterior surface of the inner shell of the receptacle connector. Ultimately the connector assembly including the contact module and both halves are held in place by the tabs of the clip on each opposing side (exterior surface) of the shell as shown in FIG. 1. FIG. 1 illustrates a schematic block diagram of a plug connector's outer shell 110, retaining clip 130 and slots 120 along the longitudinal sides of the connector according to the present inventions;

Initially (prior to closing of the halves to form an assembled connector with retaining device) the clip 130 may be attached to the outer shell of the plug connector by a snap fit. After the shell is closed and screwed (or otherwise fastened together), the clip is entrapped by the slots 120 in the walls of the outer shell panel and is secured at the proper position by contact with the surfaces of the inner connector and in one embodiment by the screw through the seating surface of the connector.

The retaining clip snap fit includes two (2) points on opposing sides of the outer shell as shown from the underside in FIG. 3. These points are generally at the furthest end of guides on sides 320 in the connector shell panel 350, and snap the tabs into place to extend through openings 160, 260, 360 in the outer shell and subsequently fit within slots on the interior shell. The snap fit points work in conjunction with the tab insert to align and secure the clip against the outer shell exterior surface relative to the longitudinal sides of the connector. The leading and trailing side edges of the connectors align on a surface in a plane of the connector seating surface 330 above the edges on sides 320 of the connector in order to allow a screw 340 or other securing device to secure first and second seating surfaces of the connectors from the top, and, the clip bend portion comes up from the sides 320 of the connector to straddle across and against this screw seating surface 330. The bend portion has a jog that forms a seat which straddles the first seating surface and the second seating surface of the electrical connectors. The first seating surface and second seating surface of the electrical connectors are thus capable of adjoining by use of a fastener through said seating surfaces. The screw seating surface 330 secures the clip so that it cannot become canted at an angle from side edge to side edge of the shell panel 350. This alignment and securing of the retaining clip ensures proper alignment of the clip prior to joining together of the two connector halves. After joining of the two connectors, the clip is trapped in the proper alignment; a screw 340 may be used to ensure proper alignment of the connectors. This proper alignment is critical in ensuring proper electrical engagement between contact modules when the connector assembly is joined to produce an electrical connection.

The rectangular shape of the preferred embodiment connector is shown in FIG. 2. and the accurate alignment of the retaining clip within the connector shell, a retaining clip could be attached from either side of the shell, though depending on the placement of the retaining slots 220 on the outer shell panel, the clips for each side may differ in size. Further, the rectangular shape allows an entirely parallel alignment of connecting electrical contact modules regardless of from which side a connection retaining clip is used.

The retaining clip 130 can be inserted from an opposite end of the slots 120. That is, according to first and second alternatives, opposite to the clip insertion direction illustrated in FIGS. 1-3. In a first alternative, the elongated ends of the clip 130 are capable of disposal along the sides of the first electrical connector on an opposite side as and incongruent with the slots 120. By the clip 130 being incongruent with the slots 120 we mean that it is at least not of the same length. In a second alternative, the elongated ends of the clip are capable of disposal along the sides of the electrical connector on an opposite side as and congruent with the slots 120. By the clip 130 being congruent with the slots 120 we mean that it is at least of the same length. When the clip 130 is the same length as the slots 120, the slot can extend to at least at a midpoint of the connector side and the clip length can be about 50% the length of the connector side.

Figure 4:
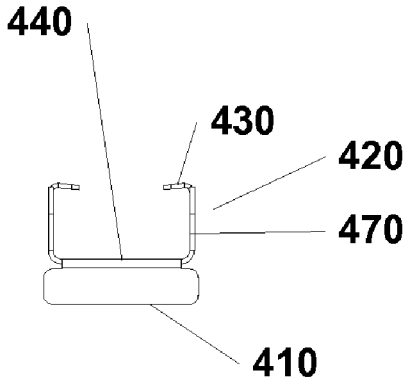
FIG. 4 illustrates a schematic block diagram of an exemplary longitudinal view of the retention clip of the present inventions.
Figure 5:
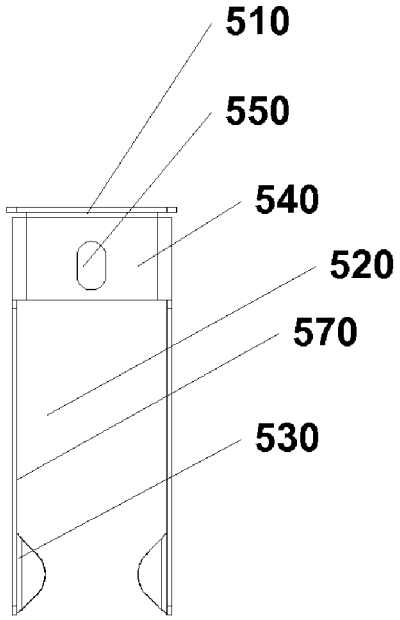
FIG. 5 illustrates a schematic block diagram of exemplary top view of the retention clip of the present inventions.
Figure 6:
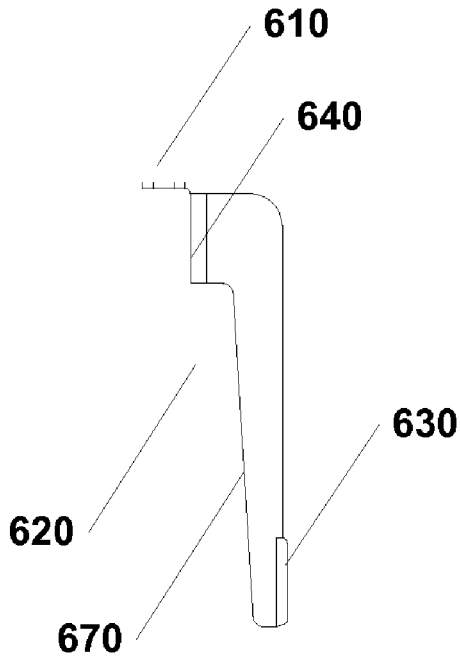
FIG. 6 illustrates a schematic block diagram of exemplary side view of the retention clip of the present inventions.

The preferred retaining device which secures the connectors is a clip. The shape of the retaining device is shown in FIG. 4, FIG. 5 and FIG. 6. Preferably the snap fitting of the retention clip 420, 520, 620 to the half shell occurs by snap fitting a pair of pre-bent tabs 430, 530, 630 into snap fit points which secure the retention clip on opposing edges of the connector. Preferably the snap fit points conform to the pre-bent tabs extending from the lower surface of the clips elongated member. In the example of the embodiment, one electrical connector contains an inner longitudinal surface capable of fitting inside the surrounding longitudinal surface of a mating connector. The lower surface 470, 570, 670 of the clip 420, 520, 620 is placed adjacent to the longitudinal surface of the connector plugs outer shell, and the pre-bent tabs 430, 530, 630 slide into position against the outer shell panel through openings 160, 260, 360 in the outer shell and rest inside slotted surfaces on the exterior surface of the outer shell.

As the pre-bent tabs 430, 530, 630 slide into position, an insert shape, which is preferably a screw, is inserted through an opening 550 in the upper surface 440, 540, 640 of the bend portion of the retention clip 520, to extend up through an exterior screw plane in the seating surface of the plugs outer shell. Preferably the upper surface 440, 540, 640 of the bend portion of the illustrated retention clip 420, 520, 620 is substantially perpendicular to the lower surfaces 470, 570, 670. This upper surface comprises the jog that forms a seat which straddles the first seating surface and the second seating surface of the electrical connectors. Additionally a flange 410, 510, 610 is also provided at the bend portion of the clip of a size and configuration sufficient for a handhold or for screwdriver access. In a further embodiment an opening 550 on the upper surface 440, 540, 640 of the bend portion allows a fastener such as a screw to secure the electrical connectors. The fastener through opening 550 and the two tabs 530 provide a three point alignment and a secure attachment of the retention clip to the plug connector's outer shell on the connector assembly.

Optionally, a second pair of snap fit points 630, which could align and secure a retaining clip 620 from the opposite edge of the connector, may be used to retain the connector from the opposite direction. Preferably the second pair of snap fit points would not be used if the first pair of snap points were used and are there to allow the flexibility to connect from either side though only one retaining clip would be needed in any complete connector assembly.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure. For example, although the exemplary kit shows a typical copper wire connector, known as a "Telco connector" commonly used to attach copper pair cables to a circuit board in examples disclosed using and angled entry; the inventions are applicable to coaxial or optical connections to circuit boards, for direct perpendicular entry including connections in free space.

What is claimed is:

1. A clip capable of removably securing a pair of mating electrical connectors to one another to make an electrical connection, wherein a first electrical connector of the pair has a first seating surface capable of adjoining with a second seating surface on a second electrical connector of the pair, wherein said clip comprises:

an elongated member comprising a first retention tab near one end of the elongated member; and a second retention tab near an opposite end of the elongated member;

wherein the elongated member is formed in a U shape about a bend portion such that the first and second retention tabs extend and point inwardly;

wherein the bend portion has a jog that forms an upper surface which straddles the first seating surface and the second seating surface of the electrical connectors of the pair;

wherein the upper surface of the bend portion is substantially parallel to a plane of the U shape of the elongated member; and wherein the bend portion of the clip comprises a hole capable of accommodating a fastener and allows the seating surfaces of the connectors and clip to be secured by said fastener.

2. A clip according to claim 1, wherein the retention tabs of said clip are capable of being secured in slots on opposing longitudinal sides of a surrounding longitudinal surface of the first electrical connector; and wherein the retention tabs of the clip are capable of fitting in place on the longitudinal surface of the first connector prior to insertion of said connector into the second connector; and wherein the retention tabs on said clip are capable of bending to accommodate insertion of the first connector into the second connector before locking into openings in the slots on the opposing longitudinal sides of the first connector.

3. A clip according to claim 2, wherein the ends of the elongated member are capable of disposal along the sides of the first electrical connector on a same side as the slots.

4. A clip according to claim 1, wherein said clip is capable of being disposed along sides of the first electrical connector outside of the slots on the sides of the first electrical connector.

5. A clip according to claim 1, wherein said clip includes a flange at the bend portion of the clip of a size and configuration sufficient for a handhold.

6. A clip according to claim 1, wherein said clip includes a flange at the bend portion of the clip of a size and configuration sufficient for screwdriver access.

7. A clip according to claim 1, wherein only one fastener is used to secure the seating surfaces of the first and second electrical connectors.

8. A clip according to claim 1, wherein the first electrical connector of the pair has a body formed by sidewalls;

wherein the first seating surface of the first electrical connector is substantially perpendicular to the sidewalls;

wherein the jog that forms an upper surface is capable of straddling in parallel fashion the first seating surface and the second seating surface of the electrical connectors of the pair; and wherein the first and second lower surfaces of the elongated members are substantially parallel to the sidewalls.

9. A kit for providing a first electrical connector, the first electrical connector being capable of mating with a second electrical connector having a seating surface, comprising:

a first electrical connector having a first seating surface;

wherein the first electrical connector is capable of mating with the second electrical connector to make an electrical connection; and wherein the first electrical connector has a seating surface capable of adjoining with the seating surface of the second electrical connector; and a clip comprising an elongated member having a first retention tab near one end of the elongated member; and a second retention tab near an opposite end of the elongated member;

wherein the elongated member is formed in a U shape about a bend portion such that the first and second retention tabs extend and point inwardly;

wherein the bend portion has a jog that forms an upper surface which straddles the seating surfaces of the first electrical connector and the second electrical connector;

wherein the upper surface of the bend portion is substantially parallel to a plane of the U shape of the elongated member;

wherein the kit further comprises a fastener;

wherein the seating surfaces of the electrical connectors are capable of adjoining by use of the fastener through the seating surfaces; and wherein the bend portion of the clip comprises a hole capable of accommodating said fastener that allows the surfaces of the connectors and clip to be secured by said fastener.

10. A kit as in claim 9, wherein the fastener comprises a rivet or a screw.

11. A kit according to claim 9, wherein the first electrical connector contains a surrounding longitudinal surface and has slots on opposing longitudinal sides capable of accommodating the retention tabs of said clip; and wherein the retention tabs of the clip are capable of fitting in place on the surface of the first connector prior to insertion of said connector into the second connector; and the retention tabs on said clip are capable of bending to accommodate insertion of the first connector into the second connector before locking into openings in the slots on the opposing longitudinal sides of the first connector.

12. A kit according to claim 9, wherein at least the first electrical connector has slots on its' sides; and wherein said clip is capable of being disposed along the sides of the first electrical connector outside of the slots.

13. A kit according to claim 9, wherein said clip includes a flange at the bend portion of the clip of a size and configuration sufficient for a handhold.

14. A kit according to claim 9, wherein at least the first electrical connector has slots on its' sides; and wherein said clip is capable of being disposed along the sides of the first electrical connector within the slots.

15. A kit according to claim 9, wherein said first and second retention tabs of said clip are shaped such that they are capable of being disposed along sides of one of the electrical connectors and extend through openings in its outer shell to secure thereto the other of the connectors.

16. A kit according to claim 15, wherein the first electrical connector comprises said openings in its outer shell on its sides to accommodate said first and second retention tabs.

17. A kit according to claim 9, wherein only one fastener is used to secure the seating surfaces of the first and second electrical connectors.

18. A kit according to claim 9, wherein the first electrical connector of the pair has a body formed by sidewalls;

wherein the first seating surface of the first electrical connector is substantially perpendicular to the sidewalls;

wherein the jog that forms an upper surface is capable of straddling in parallel fashion the first seating surface and the second seating surface of the electrical connectors of the pair; and wherein the first and second lower surfaces of the elongated members are substantially parallel to the sidewalls.

* * * * *